US009456276B1

(12) United States Patent
Chhetri

(10) Patent No.: US 9,456,276 B1
(45) Date of Patent: Sep. 27, 2016

(54) PARAMETER SELECTION FOR AUDIO BEAMFORMING

(71) Applicant: Rawles LLC, Wilmington, DE (US)

(72) Inventor: Amit Singh Chhetri, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 65 days.

(21) Appl. No.: 14/503,031

(22) Filed: Sep. 30, 2014

(51) Int. Cl.
*H04R 3/00* (2006.01)

(52) U.S. Cl.
CPC ..... *H04R 3/005* (2013.01)

(58) Field of Classification Search
None
See application file for complete search history.

(56) References Cited

U.S. PATENT DOCUMENTS 5,022,082 A * 6/1991 Eriksson ..... G10K 11/1784 381/71.8
5,028,931 A * 7/1991 Ward ..... G01S 7/2813 342/380
5,343,521 A * 8/1994 Jullien ..... H04B 3/23 370/290
5,825,898 A * 10/1998 Marash ..... G01S 7/2813 367/119
6,032,115 A * 2/2000 Kanazawa ..... G10L 15/065 704/234
7,418,392 B1 8/2008 Mozer et al.
7,720,683 B1 5/2010 Vermeulen et al.
7,774,204 B2 8/2010 Mozer et al.
2005/0281415 A1* 12/2005 Lambert ..... H04R 3/005 381/92
2006/0002546 A1* 1/2006 Stokes, III ..... H04M 9/082 379/406.06
2009/0190774 A1* 7/2009 Wang ..... G10L 21/028 381/92
2010/0014690 A1* 1/2010 Wolff ..... H04R 3/005 381/92
2010/0177908 A1* 7/2010 Seltzer ..... H04R 3/005 381/92
2012/0223885 A1 9/2012 Perez
2014/0270245 A1* 9/2014 Elko ..... H04R 3/005 381/92

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.
Doclo, et al., "Superdirective Beamforming Robust Against Microphone Mismatch", IEEE Transactions on Audio, Speech, and Language Processing, vol. 15, No. 2, Feb. 2007, p. 617-631.

* cited by examiner

*Primary Examiner* — Peter Vincent Agustin
(74) *Attorney, Agent, or Firm* — Lee & Hayes, PLLC

(57) ABSTRACT

An audio beamformer receives signals from microphones of an array and processes the signals to produce a directional audio signal that emphasizes sound from a selected direction. The beamformer is implemented using weights or other parameters that are calculated to account for effects upon the received audio signals by the surfaces upon which the microphones are positioned.

19 Claims, 5 Drawing Sheets

PARAMETER SELECTION FOR AUDIO BEAMFORMING

BACKGROUND

Audio beamforming may be used in various types of situations and devices in order to emphasize sound received from a particular direction. Beamforming can be implemented in different ways, depending on system objectives.

Superdirective beamforming is a particular beamforming technique in which parameters are selected so as to maximize directivity in a diffuse noise field.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

An audio beamformer receives audio signals from microphones of a microphone array and processes the signals to produce a directional audio signal that emphasizes sound from a selected direction. A superdirective beamformer is a particular type of beamformer that is implemented so as to maximize directivity in a diffuse noise field.

The microphones of a microphone array are positioned on a solid, rigid surface that produces diffraction and scattering of a received sound wave. In described embodiments, the effects of the diffraction and scattering upon captured audio signals are determined for multiple frequencies and directions either by experimentation or by mathematical modelling. Parameters of a superdirective beamformer are then calculated based on the determined diffraction and scattering effects.

Figure 1:
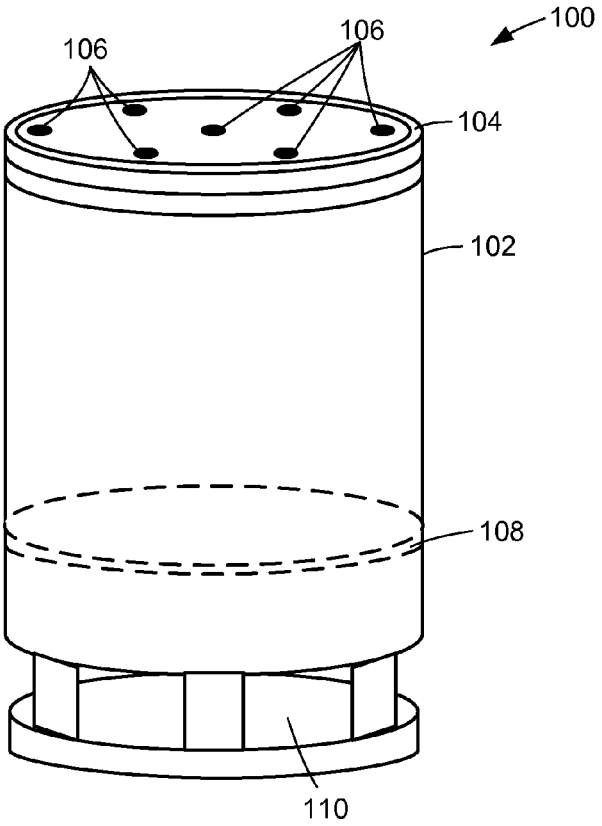
FIG. 1 is a front perspective view of an example device having a microphone array that may be used in conjunction with beamforming techniques as describe herein.
Figure 2:
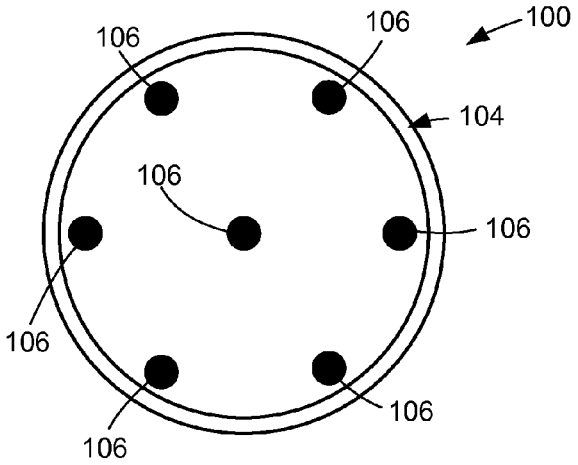
FIG. 2 is a top view of the example device of FIG. 1.

FIGS. 1 and 2 show an example of a device 100 that implements audio beamforming to produce a directional audio signal emphasizing sound that originates from a selected direction relative to the device 100. The device 100 comprises a cylinder 102 or other rigid body having a planar, circular top surface 104. A microphone array is formed by multiple input microphones or microphone elements 106 on the top surface 104.

In the illustrated example, each of the microphones 106 comprises an omnidirectional or non-directional microphone that responds equally to sounds originating from different horizontal directions. One of the input microphones 106 is positioned at the center of the top surface 104. Six other microphones 106 are arranged symmetrically around the periphery of the top surface 104 in a circular or hexagonal pattern, so that they are equidistant from each other.

Figure 3A:
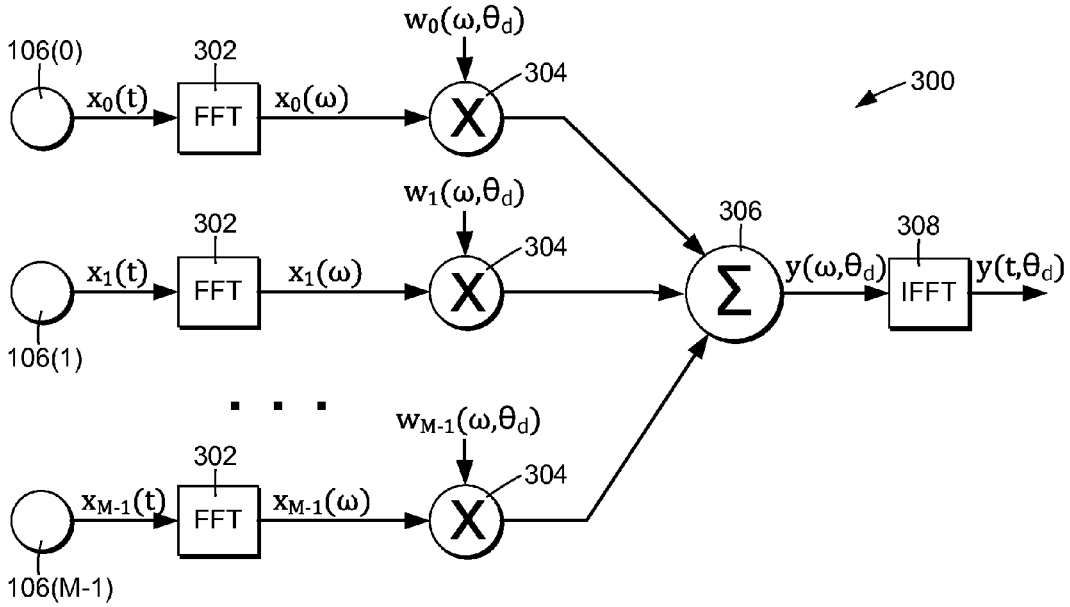
FIG. 3A is a block diagram illustrating an example frequency-domain implementation of a superdirective beamformer.

FIG. 3A illustrates logical components of an example superdirective beamformer 300 that may be used to perform audio beamforming in a system or apparatus such as the device 100. In a device that includes M microphones 106, the beamformer 300 receives M time domain audio signals $x_m(t)$ captured by multiple microphones 106(0) through 106(M−1). The nomenclature $x_m(t)$ indicates a time domain signal corresponding to the $m^{th}$ microphone of the array, wherein the signal $x_m(t)$ has a value that is a function of time t. The time-domain signals $x_0(t)$ through $x_{M-1}(t)$ are converted to frequency domain signals $x_0(\omega)$ through $x_{M-1}(\omega)$ by fast Fourier transforms (FFTs) 302. The nomenclature $x_m(\omega)$ indicates a frequency domain signal corresponding to the $m^{th}$ microphone of the array, wherein the signal $x_m(\omega)$ has a value that is a function of the frequency ω. The frequency domain signal has multiple frequency components, corresponding to different frequencies ω.

The frequency components of each frequency domain signal $x_m(\omega)$ are multiplied by corresponding weights $w_m(\omega, \theta_d)$ by a filter or weighting function 304. The filter weights $w_m(\omega,\theta_d)$ are calculated as function of a selected direction $\theta_d$ from which sounds are to be emphasized by the beamformer. The direction $\theta_d$ is referred to as the focus direction of the beamformer.

The resulting filtered or weighted signals are then summed at 306 to produce a directional frequency domain signal $y(\omega, \theta_d)$, which is converted to the time domain by an inverse fast Fourier transform (IFFT) 308 to produce a directional time-domain audio signal $y(t,\theta_d)$ that emphasizes sounds received from the focus direction $\theta_d$.

The objective of superdirective beamforming is to maximize the output signal-to-noise ratio (SNR) under the condition that the noise field is spherically diffuse, in order to provide maximum directivity across all frequencies. In order to achieve this objective, the weights $W(\omega,\theta_d)$ for the microphones are calculated as $$W(\omega, \theta_d) = \frac{\left(\Psi_{NN}^{Diff}\right)^{-1} v(\omega, \theta_d)}{v^H(\omega, \theta_d)\left(\Psi_{NN}^{Diff}\right)^{-1} v(\omega, \theta_d)} \qquad \text{Equation 1}$$

where $\Psi_{NN}^{Diff}$ is a normalized noise correlation matrix for spherically diffuse noise and $v(\omega, \theta_d)$ is an array manifold vector for the selected direction $\theta_d$ from which sound will be emphasized by the beamformer. The superscript −1 indicates an inverse matrix operation.

The superscript H indicates a Hermitian matrix transposition operation, which is performed by taking the regular transpose of a matrix and computing the complex conjugate of each element of the transposed matrix. Mathematically, the Hermitian transform of a matrix A is conj ($A^T$), where the "conj" operator indicates the complex conjugate of $A^T$ and the superscript T indicates the regular matrix transpose operation.

Figure 3B:
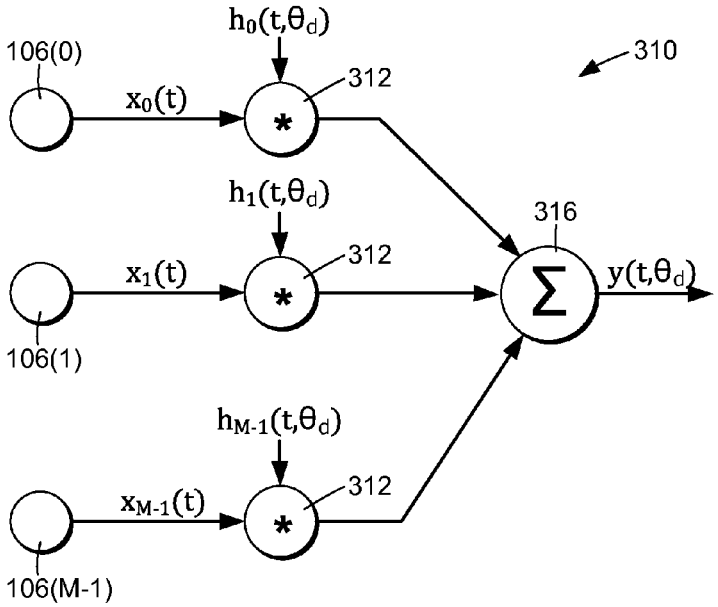
FIG. 3B is a block diagram illustrating an example time-domain implementation of a superdirective beamformer.

FIG. 3B illustrates an example of a superdirective beamformer 310 implemented in the time domain. In the time-domain implementation, each of the time-domain microphone signals $x_m(t)$ is convolved by coefficients or parameters $h_m(t,\theta_d)$ by a convolution function or operation 312, wherein the coefficients or parameters $h_m(t, \theta_d)$ are calculated by taking the inverse fast Fourier transform of the weights $w_m(\omega, \theta_d)$. The results are summed at 316 to produce the directional time-domain audio signal $y(t, \theta_d)$.

Figure 4:
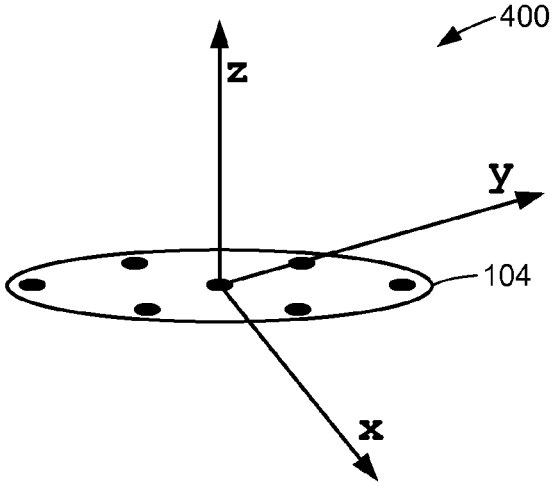
FIG. 4 illustrates a Cartesian coordinate system in relation to the device of FIG. 1.

FIG. 4 shows a Cartesian coordinate system relative to a circular microphone array 400 such as may be positioned on the top surface of the device 100. The x and y axes correspond to orthogonal horizontal directions. The z axis corresponds to a vertical direction.

Figure 5:
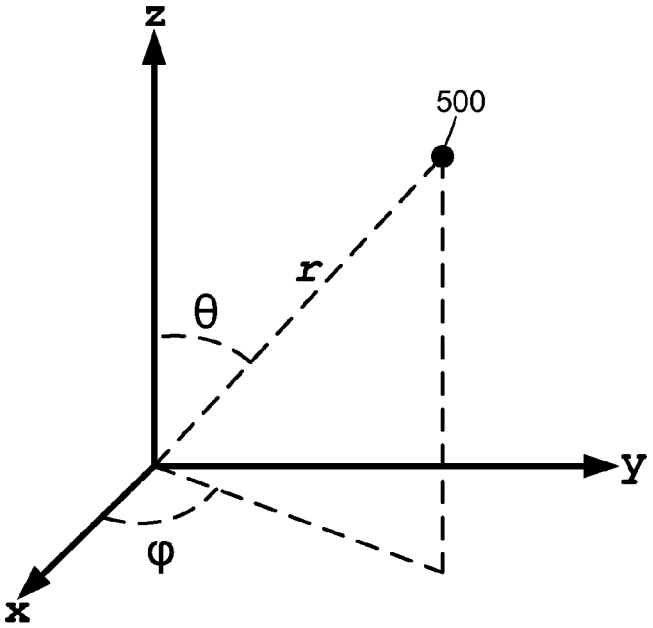
FIG. 5 illustrates a polar coordinate system in relation to a Cartesian coordinate system.

FIG. 5 illustrates a spherical coordinate system that may be defined relative to the Cartesian coordinate system of FIG. 4 in order to specify an arbitrary point 500 in three-dimensional (3D) space relative to the microphone array 400. In the spherical coordinate system, r is the radial distance of the point 500 from the Cartesian origin, which may be defined to coincide with the center microphone 106. The angle θ, called the polar angle, is the angle between the z axis and a line from the Cartesian origin to the point 500. The angle ϕ, called the azimuth angle, is the angle between the x axis and the projection onto the x-y plane of the line from the Cartesian original to the point 500. The mapping from the spherical coordinate system to the 3D Cartesian coordinate system is as follows:

$$x=r\sin(\theta)\cos(\phi) \quad \text{Equation 2}$$

$$y=r\sin(\theta)\sin(\phi) \quad \text{Equation 3}$$

$$z=r\cos(\theta) \quad \text{Equation 4}$$

The position of the $m^{th}$ microphone of an array consisting of M microphones is denoted herein as $p_m$. The acoustic signal acquired at the $m^{th}$ microphone at time t is denoted as $f(t,p_m)$. The signal acquired by a microphone array of M microphones can be expressed as $$f(t, p) = \begin{bmatrix} f(t, p_0) \\ f(t, p_1) \\ \vdots \\ f(t, p_{M-1}) \end{bmatrix} \quad \text{Equation 5}$$

For a sound source located along the direction of $\Theta \triangleq \{\theta, \phi\}$, the unit vector pointing toward the direction Θ is $$u=[\sin\theta\cos\phi\ \sin\theta\sin\phi\ \cos\theta] \quad \text{Equation 6}$$

For a monochromatic plane wave arriving from a source located along u, the wavenumber can be expressed as $$k = -\frac{2\pi}{\lambda}u \quad \text{Equation 7}$$

where λ is the wavelength of the plane wave.

Under free-field and far-field conditions, and for an ideal omnidirectional microphone array, the signal captured by the $m^{th}$ microphone can be expressed as $$f(t,p_m)=A\exp\{j(\omega t-k^T p_m)\} \quad \text{Equation 8}$$

where A, in general, is complex valued. The superscript T indicates a matrix transposition operation.

Based on Equation 8, the basis function for a propagating plane wave can be expressed as $$f_{Basis}(t,p)=\exp\{j(\omega t-k^T p)\}=\exp(j\omega t)\cdot\exp(-jk^T p) \quad \text{Equation 9}$$

In general, then, it may be said that $$f_{Basis}(t, p) = \exp(j\omega t)\cdot\begin{bmatrix} \exp(-jk^T p_0) \\ \exp(-jk^T p_1) \\ \vdots \\ \exp(-jk^T p_{M-1}) \end{bmatrix} = \exp(j\omega t)\cdot v(k) \quad \text{Equation 10}$$

where v(k) is an array manifold vector defined as $$v(k) \triangleq \begin{bmatrix} \exp(-jk^T p_0) \\ \exp(-jk^T p_1) \\ \vdots \\ \exp(-jk^T p_{M-1}) \end{bmatrix} \quad \text{Equation 11}$$

The array manifold vector of Equation 11 incorporates all of the spatial characteristics of the microphone array, based on free-field and far-field assumptions. Because the wave-number k captures both frequency and direction components, v(k) can also be referred to as $v(\omega, \Theta)$. $v_m(\omega, \Theta)$ indicates the $m^{th}$ element of $v(\omega, \Theta)$, which corresponds to the microphone at position $p_m$. Θ indicates a direction relative to device 100 and/or its microphone array.

Because the microphones in the device 100 are surface mounted, the free-field and far-field assumptions upon which Equation 11 are based break down. In fact, the top surface may result in frequency and angle dependent diffraction and scattering effects. Thus, for a propagating plane wave, the signal observed by the microphones 106 on the top surface of the cylinder 102 is not accurately represented by Equation 11.

The effects of diffraction and scattering on a propagating plane wave impinging a surface at the position $p_m$ of the $m^{th}$ microphone from a direction Θ can be represented as a correction vector $A_m(\omega, \Theta)$ as follows:

$$A_m(\omega,\Theta)=a_m(\omega,\Theta)e^{j\phi_m(\omega,\Theta)} \quad \text{Equation 12}$$

where $a_m(\omega, \Theta)$ represents the magnitude of diffraction and scattering effects at the $m^{th}$ microphone for the frequency ω and arrival direction Θ and $\phi_m(\omega, \Theta)$ represents the phase of the diffraction and scattering effects at the $m^{th}$ microphone for the frequency ω and arrival direction Θ. Under ideal free-field and far-field conditions, $a_m(\omega, \Theta)$ would be equal to unity. The elements of the correction value $A_m(\omega, \Theta)$ can be determined by experiment or by mathematical modelling.

The surface effects represented by $a_m(\omega, \Theta)$ and $\phi_m(\omega, \Theta)$ can be accounted for in the array manifold vector as follows:

$$\tilde{v}_m(k) \triangleq \tilde{v}_m(\omega,\Theta) \triangleq A_m(\omega,\Theta)\exp(-jk^T p_m). \quad \text{Equation 13}$$

where k is the wavenumber corresponding to the frequency ω and direction Θ.

The corrected array manifold vector is:

$$\tilde{v}(k) \triangleq \tilde{v}(\omega, \Theta) \triangleq \begin{bmatrix} A_0(\omega, \Theta)\exp(-jk^T p_0) \\ A_1(\omega, \Theta)\exp(-jk^T p_1) \\ \vdots \\ A_{M-1}(\omega, \Theta)\exp(-jk^T p_{M-1}) \end{bmatrix} \quad \text{Equation 14}$$

or $$\tilde{v}(k) \triangleq \tilde{v}(\omega, \Theta) \triangleq \begin{bmatrix} \tilde{v}_0(\omega, \Theta) \\ \tilde{v}_1(\omega, \Theta) \\ \vdots \\ \tilde{v}_{M-1}(\omega, \Theta) \end{bmatrix} \quad \text{Equation 15}$$

Equation 1 may be modified or corrected to calculate weights W for a superdirective beamformer by substituting the corrected array manifold vector $\tilde{v}(\omega, \Theta)$ for the ideal manifold vector $v(\omega, \Theta)$ as follows:

$$W(\omega, \Theta_d) = \frac{(\tilde{\Psi}_{NN}^{Diff})^{-1}\tilde{v}(\omega, \Theta_d)}{\tilde{v}^H(\omega, \Theta_d)(\tilde{\Psi}_{NN}^{Diff})^{-1}\tilde{v}(\omega, \Theta_d)} \quad \text{Equation 16}$$

where $\theta_d$ is the focus direction from which sounds are emphasized by the resulting beamformer. The weight vector $w_m(\omega, \Theta)$, comprising weights corresponding to single microphone m for a focus direction $\Theta_d$, is corrected and calculated as follows:

$$w_m(\omega, \Theta_d) = \frac{(\tilde{\Psi}_{NN}^{Diff})^{-1}\tilde{v}_m(\omega, \Theta_d)}{\tilde{v}_m^H(\omega, \Theta_d)(\tilde{\Psi}_{NN}^{Diff})^{-1}\tilde{v}_m(\omega, \Theta_d)} \quad \text{Equation 17}$$

Weights calculated in this manner may be used in the beamformer 300 to account for the diffraction and scattering effects of the surface upon which the microphones are mounted.

Figure 6:
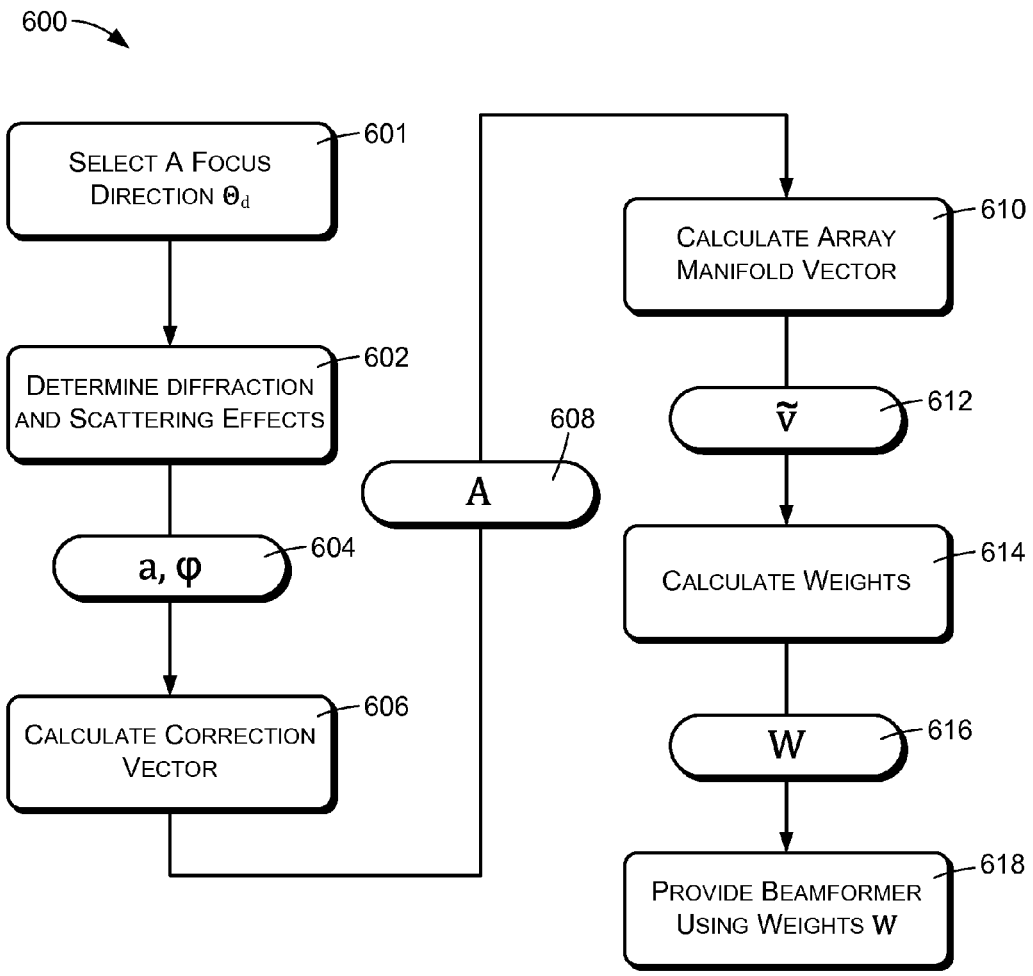
FIG. 6 is a flow diagram illustrating selection of parameters or weights for use in a superdirective beamformer.

FIG. 6 shows an example method 600 of determining weights for use in a beamformer such as a superdirective beamformer that receives input signals corresponding respectively to microphones of a microphone array, where each microphone m is at a position $p_m$ on an acoustically reflective surface.

An action 601 comprises selecting the focus direction $\Theta_d$ of the beamformer, which is the direction from which sounds will be emphasized by the beamformer.

An action 602 comprises determining diffraction and scattering effects 604 caused by the surface at each microphone position $p_m$, for multiple frequencies $\omega$ and multiple angles of incidence $\Theta$ of an impinging sound wave. The diffraction and scattering effects 604 may include a magnitude a and a phase $\phi$ for each of the multiple frequencies and angles of incidence. The diffraction and scattering components may be indicated as $a_m(\omega, \Theta)$ for each position $p_m$ and $\phi_m(\omega, \Theta)$ for each position $p_m$, where $\omega$ is the frequency of an impinging sound wave and $\Theta$ is the direction from which the impinging sound wave originates.

Determining the diffraction and scattering effects may be performed by mathematically modeling physical characteristics of the device 100 with respect to sound waves of different frequencies arriving from different directions. Alternatively, the diffraction and scattering effects may be determined by experiment, observation, and/or measurement.

An action 606 comprises calculating a correction vector 608 corresponding to each microphone position $p_m$. The correction vector comprises individual correction values corresponding respectively to multiple frequencies, each of which indicates magnitude differences and phase differences of the input signal caused by the surface upon which the microphone is positioned, in comparison to a free-field input signal that would be produced by a microphone in free space in response to a sound wave arriving from the focus direction $\Theta_d$.

An action 610 comprises calculating a corrected array manifold vector 612 that accounts for the effects of diffraction and scattering by the surface upon which the microphones are positioned. The corrected array manifold vector $\tilde{v}$ comprises multiple elements $\tilde{v}_m$, each of which corresponds to a position $p_m$:

$$\tilde{v} \triangleq \begin{bmatrix} \tilde{v}_0 \\ \tilde{v}_1 \\ \vdots \\ \tilde{v}_{M-1} \end{bmatrix} \quad \text{Equation 18}$$

where $\tilde{v}_m \triangleq A_m \exp(-jk^T p_m)$.

An action 614 comprises calculating weights 616, based on the corrected array manifold vector $\tilde{v}$, corresponding respectively to each of the microphones of the microphone array. For example, weights $w_m(\omega)$, corresponding to the microphone at position $p_m$, may be calculated as $$w_m(\omega) = \frac{(\tilde{\Psi}_{NN}^{Diff})^{-1}\tilde{v}_m}{\tilde{v}_m^H(\tilde{\Psi}_{NN}^{Diff})^{-1}\tilde{v}_m} \quad \text{Equation 19}$$

An action 618 comprises providing or implementing an audio beamformer using the calculated weights 616. The weights as calculated above result in what is referred to as a superdirective beamformer.

Figure 7:
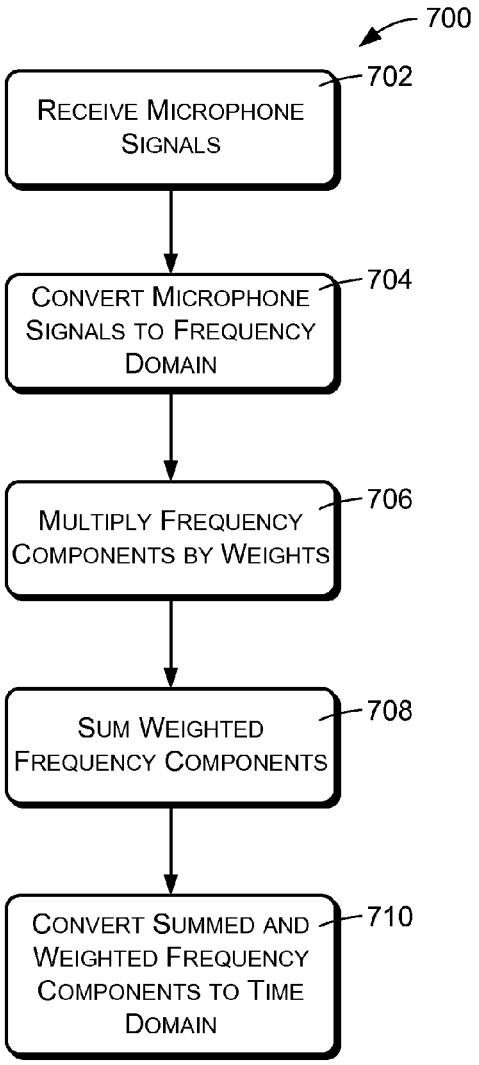
FIG. 7 is a flow diagram illustrating operational aspects of a superdirective beamformer.

FIG. 7 illustrates an example method 700 of beamforming. The method 700 implements the technique shown in FIG. 3A. An action 702 comprises receiving microphone signals generated by multiple microphones of a microphone array. An action 704 comprises performing FFT to convert the microphone signals to the frequency domain. An action 706 comprises multiplying the frequency components of the microphone signals by the weights calculated in the method 600. An action 708 comprises summing the weighted frequency components corresponding to the multiple microphones. An action 710 comprises converting the weighted and summed frequency components back to the time domain using an IFFT, resulting in an audio signal that emphasizes sound from the selected focus direction $\Theta_d$.

The operation of a superdirective beamformer in the frequency domain may be represented as follows:

$$y(\omega, \Theta_d) = \sum_{m=0}^{M-1} w_m(\omega, \Theta_d) x_m(\omega). \quad \text{Equation 20}$$

The normalized noise correlation matrix $\Psi_{NN}^{Diff}$ used in the above calculations is determined in the context of an M-channel microphone array immersed in a spherically-diffuse noise field. The noise component of the $m^{th}$ microphone signal in the frequency domain can be represented as $N_m(\omega)$. A noise vector, having noise components for each of the M microphones, is represented as $N(\omega)=[N_0(\omega)\ N_1(\omega)\ \ldots\ N_{M-1}(\omega)]^T$. The normalized noise correlation matrix for spherically diffuse noise is then defined as $$\Psi_{NN}^{Diff}(\omega) = \frac{E\{N(\omega)N^H(\omega)\}}{E\{|N_r(\omega)^2|\}} \quad \text{Equation 21}$$

where the E( ) is the statistical expectation operation and $E\{|N_r(\omega)|^2\}$ is the noise energy measured by a reference omni-directional microphone.

Although the preceding description assumes the implementation of a superdirective beamformer in the frequency domain, similar techniques may be used to implement superdirective beamforming in the time domain, while accounting for diffraction and scattering effects caused by a rigid surface upon which the microphones are positioned. In addition, the described techniques may be used to determine weights and other parameters of different types of beamformers, not limited to superdirective beamformers.

Figure 8:
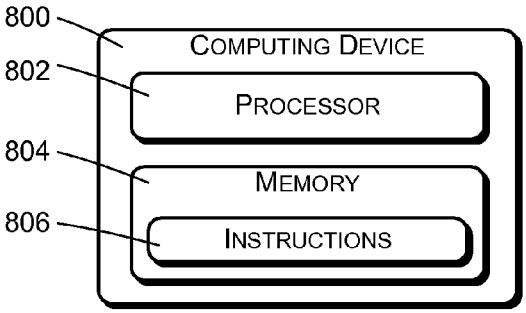
FIG. 8 is a block diagram of an example processing device that may be used to implement the techniques described herein.

FIG. 8 shows relevant components of a computing device 800 that may be configured to implement the techniques described herein. For example, a computing device such as this may be used to calculate the weights or other parameters of a beamformer as described above. As another example, a computing device such as this may be used to implement superdirective beamforming. More specifically, the actions shown in FIGS. 6 and 7 may be implemented by the computing device 800 or a similar device. In some cases, the device 100 of FIG. 1 may implement or contain the computing device 800.

The computing device 800 has a processor 802 and memory 804. The processor 802 may include multiple processors, or a processor having multiple cores. The processor 802 may comprise or include various different types of processors, including digital signal processors, graphics processors, etc.

The memory 804 may contain applications and programs in the form of computer-executable instructions 806 that are executed by the processor 802 to perform acts or actions that implement the methods and functionality described above. The memory 804 may be a type of non-transitory computer-readable storage media and may include volatile and non-volatile memory. Thus, the memory 804 may include, but is not limited to, RAM, ROM, EEPROM, flash memory, or other memory technology. The memory 804 may also include type of memory that are commonly used to transfer or distribute programs or applications, such as CD-ROMs, DVDs, thumb drives, portable disk drives, and so forth.

Although the subject matter has been described in language specific to structural features, it is to be understood that the subject matter defined in the appended claims is not necessarily limited to the specific features described. Rather, the specific features are disclosed as illustrative forms of implementing the claims.

The invention claimed is:

1. A method comprising:

receiving multiple frequency domain input signals, each input signal corresponding to a microphone of a microphone array, wherein each microphone is on a surface;

selecting a focus direction;

determining a correction vector for a first input signal corresponding to a first microphone of the microphone array, the correction vector indicating magnitude differences and phase differences at multiple frequencies of the first input signal caused by the surface in comparison to a free-field input signal that would be produced by the first microphone in free space in response to a sound wave arriving from the focus direction;

calculating filter weights corresponding to the multiple frequencies of the first input signal based at least in part on the correction vector and based at least in part on the focus direction;

multiplying frequency components of the first input signal by the filter weights to produce a first filtered signal corresponding to the first input signal; and summing multiple filtered signals corresponding respectively to the input signals to produce a directional frequency domain signal, the multiple filtered signals comprising the first filtered signal.

2. The method of claim 1, wherein determining the correction vector comprises mathematically modeling diffraction and scattering effects caused by the surface upon the first input signal at multiple frequencies and for multiple focus directions.

3. The method of claim 1, wherein determining the correction vector comprises experimentally measuring diffraction and scattering effects caused by the surface upon the first input signal at multiple frequencies and for multiple focus directions.

4. The method of claim 1, wherein the correction vector comprises correction values corresponding respectively to different frequencies ω, each correction value comprising $a_m(\omega, \Theta_d)e^{j\phi_m(\omega, \Theta_d)}$, where:

$a_m(\omega, \Theta_d)$ is the magnitude difference of the first input signal caused by the surface at frequency ω in response to a sound wave arriving from the focus direction $\Theta_d$, and $\phi_m(\omega, \Theta_d)$ is the phase difference of the first input signal caused by the surface at frequency ω in response to the sound wave arriving from the focus direction $\Theta_d$.

5. The method of claim 1, wherein calculating the frequency-domain filter weights comprises calculating $$\frac{(\tilde{\Psi}_{NN}^{Diff})^{-1}\tilde{v}_m(\omega, \Theta_d)}{\tilde{v}_m^H(\omega, \Theta_d)(\tilde{\Psi}_{NN}^{Diff})^{-1}\tilde{v}_m(\omega, \Theta_d)};$$

where:

$\tilde{v}_m(\omega, \Theta_d)$ is an array manifold vector that is calculated based at least in part on the correction vector;

$\tilde{\Psi}_{NN}^{Diff}$ is a normalized noise correlation matrix for spherically diffuse noise;

the superscript H indicates a Hermitian matrix transposition operation; and the superscript −1 indicates an inverse matrix operation.

6. A method of determining filter weights of a beamformer that processes multiple input signals, each input signal corresponding to a microphone of a microphone array, wherein each microphone is on a surface, the method comprising:

determining a correction vector for a first input signal corresponding to a first microphone of the microphone array, the correction vector indicating differences, at multiple frequencies of the first input signal, caused by the surface in comparison to a free-field input signal that would be produced by the first microphone in free space in response to a sound wave arriving from a focus direction; and calculating the filter weights corresponding to the first input signal using the correction vector.

7. The method of claim 6, wherein calculating the filter weights corresponding to the first input signal comprises calculating $$A\exp(-jk^T p);$$

where:

p is a position of the first microphone;

A is the correction vector;

the operator exp indicates an exponentiation operation;

j is an imaginary unit;

k is a unit vector corresponding to the focus direction; and the superscript T indicates a matrix transposition operation.

8. The method of claim 7, wherein calculating the filter weights further comprises calculating $$\frac{(\tilde{\Psi}_{NN}^{Diff})^{-1}\tilde{v}}{\tilde{v}^H(\tilde{\Psi}_{NN}^{Diff})^{-1}\tilde{v}};$$

where:

$\tilde{\Psi}_{NN}^{Diff}$ is a normalized noise correlation matrix for spherically diffuse noise;

$\tilde{v}$ is $A\exp(-jk^T p)$;

the superscript H indicates a Hermitian matrix transposition operation; and the superscript −1 indicates an inverse matrix operation.

9. The method of claim 6, wherein determining the correction vector comprises mathematically modeling diffraction and scattering effects caused by the surface upon the first input signal at multiple frequencies and for multiple focus directions.

10. The method of claim 6, wherein determining the correction vector comprises experimentally measuring diffraction and scattering effects caused by the surface upon the first input signal at multiple frequencies and for multiple focus directions.

11. The method of claim 6, wherein the differences include magnitude differences and phase differences.

12. The method of claim 6, wherein the filter weights are for use in a beamformer that multiplies frequency components of the input signal by the filter weights.

13. The method of claim 6, wherein the filter weights are for use in a superdirective beamformer.

14. One or more computer-readable media storing computer-executable instructions that, when executed by one or more processors, cause the one or more processors to perform acts comprising:

determining first diffraction and scattering effects caused by a surface on a first input signal received from a microphone array, the first diffraction and scattering effects comprising a first difference in magnitude and a first difference in phase caused by the surface in comparison to a free-field input signal that would be produced by the microphone array in free space in response to a sound wave arriving at the microphone array;

determining second diffraction and scattering effects caused by the surface on a second input signal received from the microphone array, the second diffraction and scattering effects comprising a second difference in magnitude and a second difference in phase caused by the surface in comparison to the free-field input signal that would be produced by the microphone array in free space in response to the sound wave arriving at the microphone array;

calculating parameters for use by an audio beamformer to process the first input signal and the second input signal received from the microphone array and to produce a directionally focused output signal;

wherein the calculating is based at least in part on the determined first diffraction and scattering effects and second diffraction and scattering effects caused by the surface.

15. The one or more computer-readable media of claim 14, wherein the first diffraction and scattering effects comprise $ae^{j\Phi}$, where:

a represents a magnitude of the first diffraction and scattering effects, and $\phi$ represents a phase of the first diffraction and scattering effects.

16. The one or more computer-readable media of claim 14, wherein each parameter comprises a weight that is calculated as:

$$\frac{(\tilde{\Psi}_{NN}^{Diff})^{-1}\tilde{v}}{\tilde{v}^H(\tilde{\Psi}_{NN}^{Diff})^{-1}\tilde{v}};$$

where:

$\tilde{\Psi}_{NN}^{Diff}$ is a normalized noise correlation matrix for spherically diffuse noise;

$\tilde{v}$ is an array manifold vector that accounts for the first diffraction and scattering effects;

the superscript H indicates a Hermitian matrix transposition operation; and the superscript −1 indicates an inverse matrix operation.

17. The one or more computer-readable media of claim 14, wherein calculating the parameters comprises calculating weights for use in a superdirective audio beamformer.

18. The one or more computer-readable media of claim 14, wherein determining the first diffraction and scattering effects and the second diffraction and scattering effects comprises mathematically modeling the first diffraction and scattering effects and the second diffraction and scattering effects.

19. The one or more computer-readable media of claim 14, wherein determining the first diffraction and scattering effects and the second diffraction and scattering effects comprises experimentally measuring the first diffraction and scattering effects and the second diffraction and scattering effects.

* * * * *